United States Patent [19]

Tarlow et al.

[11] Patent Number: 5,016,617

[45] Date of Patent: May 21, 1991

[54] AUTOMATIC BODY MASSAGING APPARATUS

[75] Inventors: Kenneth A. Tarlow, Marina del Rey, Calif.; Russell P. Wood; Christi K. Wood, both of 1000 W. Huntington Dr., Unit C, Arcadia, Calif. 91006

[73] Assignees: Russell P. Wood; Christi K. Wood, both of Arcadia, Calif.

[21] Appl. No.: 457,260

[22] Filed: Dec. 27, 1989

[51] Int. Cl.[5] ..... A61H 7/00

[52] U.S. Cl. ..... 128/52; 128/49; 128/44

[58] Field of Search ..... 128/44.49, 51.52

[56] References Cited

U.S. PATENT DOCUMENTS 3,672,357 6/1972 Ferguson ..... 128/52

*Primary Examiner*—Edgar S. Burr
*Assistant Examiner*—Lisa E. Malvaso
*Attorney, Agent, or Firm*—Poms, Smith, Lande & Rose

[57] ABSTRACT

Automatic body massaging apparatus adapted to be coupled to a bed wherein the user lies on top of the bed and the apparatus automatically massages the user's body. The apparatus includes an endless track mounted on a support having a plurality of spaced downwardly extending massaging fingers which move automatically back and forth supported by the endless track along the body of the user massaging the same.

19 Claims, 3 Drawing Sheets

10
12
13
15
16
17
18
19
20
21
22
23
24
25
26
27
28
29
30
31
32
33
34
35
36
37
38
39
41
43
44
45
49
52
54
55
56
66
67
68
71
72
73
74
76
V
VI

AUTOMATIC BODY MASSAGING APPARATUS

BACKGROUND OF THE INVENTION

1. Field of the Invention

The invention relates to body massagers; and, more particularly, to apparatus attachable to a bed or the like for automatically massaging the body of a person reclining on the bed.

2. Description of the Prior Art

Massaging is well known for relieving tension and relaxing one's body. However, masseuses are quite expensive and time consuming. Obviously, it is difficult if not impossible to massage various parts of one's own body. Even if one found a partner willing to massage one's body, such massaging is boring and tedious.

There thus exists a need for an inexpensive and easy to use apparatus for massaging one's body in the privacy of a home or the like.

SUMMARY OF THE INVENTION

It is an object of this invention to provide an apparatus for automatically massaging one's body.

It is a further object of this invention to provide such an apparatus which is quickly and easily attachable to a bed or the like.

These and other objects are preferably accomplished by providing an apparatus adapted to be coupled to a bed wherein the user lies on top of the bed and the apparatus automatically massages the user's body. The apparatus includes an endless track mounted on a support having a plurality of spaced downwardly extending massaging fingers which move automatically back and forth supported by the endless track along the body of the user massaging the same.

DESCRIPTION OF THE PREFERRED EMBODIMENT

Figure 1:
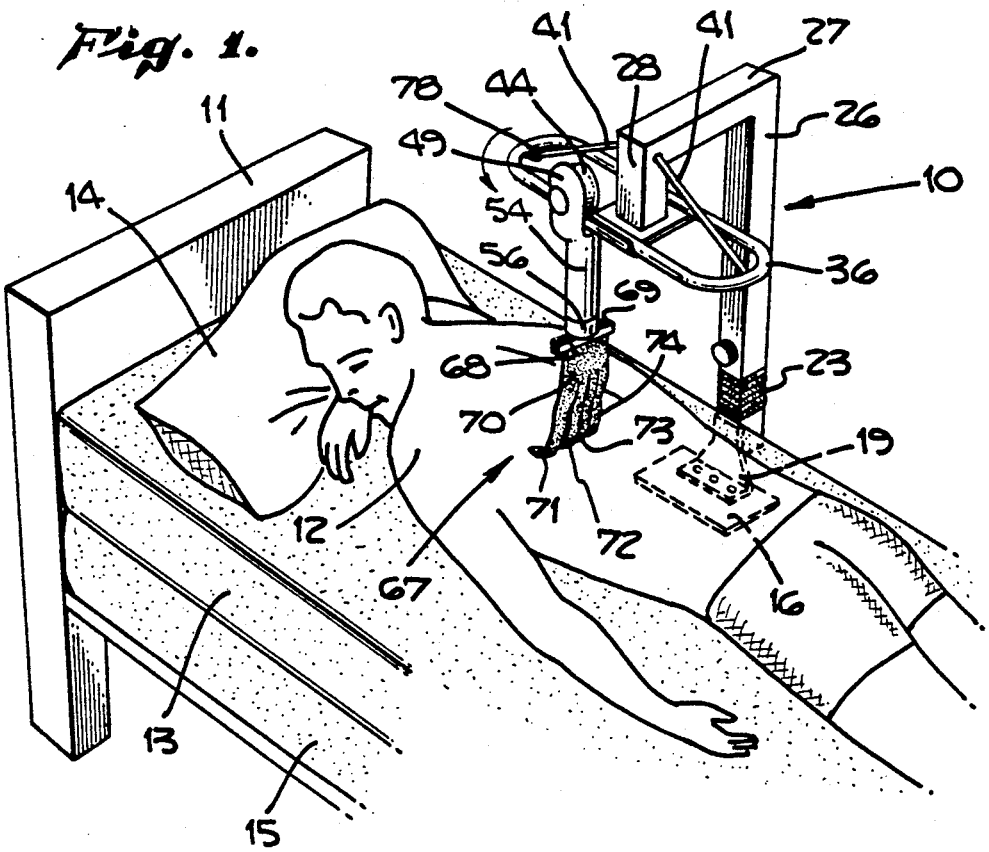
FIG. 1 is a perspective view of apparatus in accordance with the invention attached to a bed and in operation massaging the back of a user.

Referring now to FIG. 1 of the drawing, apparatus 10 in accordance with the invention is shown mounted on a bed 11. A person 12, being massaged by apparatus 10, reclines on top of mattress 13 and pillow 14. Mattress 13 is disposed on top of a box spring 15.

Figures 4, 5, 6:
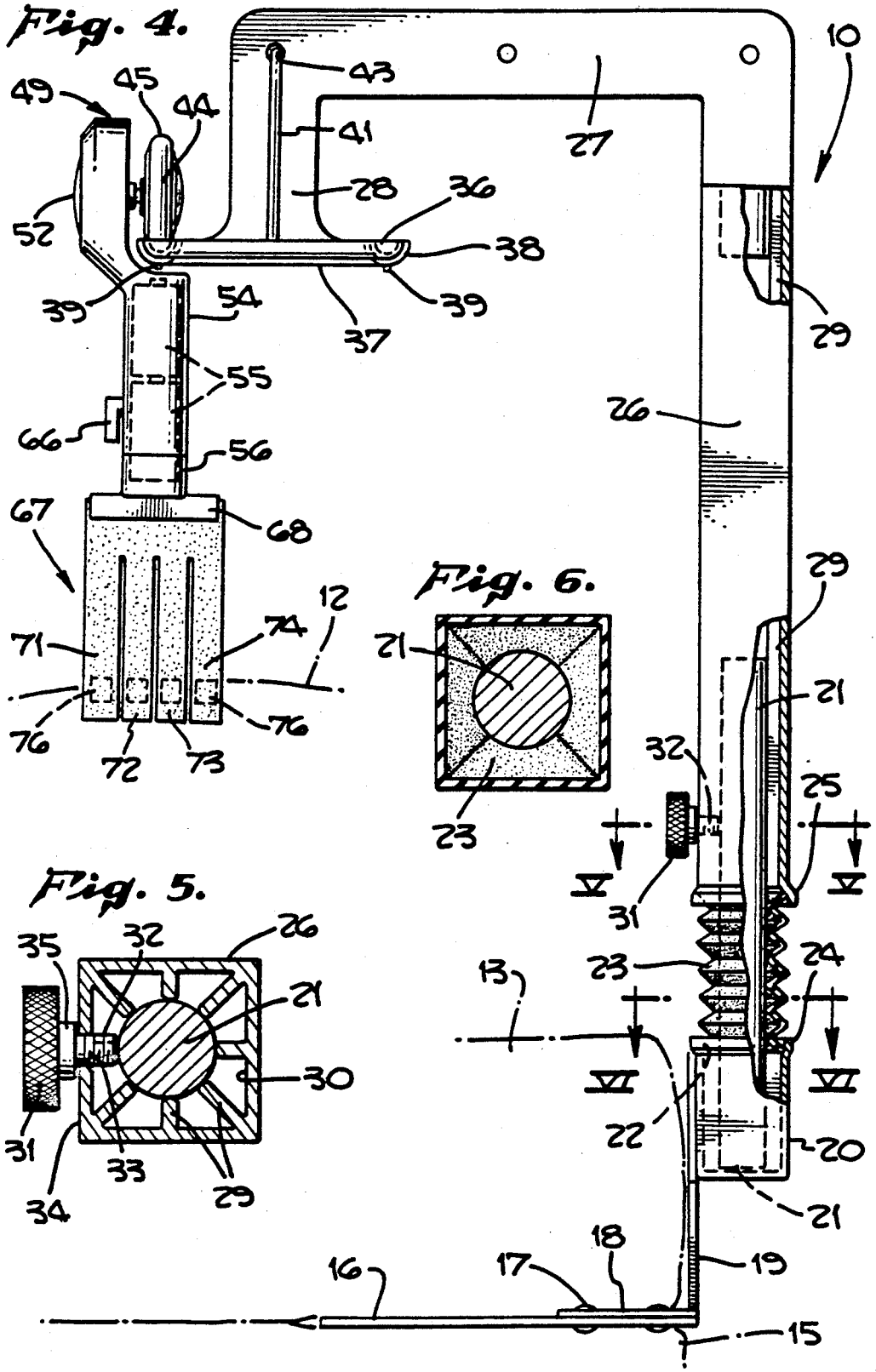
FIG. 4 is a front vertical view of the apparatus of FIG. 1.
FIGS. 5 and 6 are views taken along lines V—V and VI—VI, respectively of FIG. 4.

As seen in FIG. 4, apparatus 10 includes a flat flange plate 16 secured, via nuts or rivets 17, to an L-shaped flange plate (lower plate 18 and angled plate 19). As seen in FIG. 4, plates 16, 18 fit between mattress 13 and box spring 15 with plate 19 abutting against the side of mattress 13. A box-shaped cup 20 (see also FIG. 6) is secured to plate 19, (which may be trapezoidally-shaped—FIG. 2) in any suitable manner, such as by welding. A rod 21 is disposed within cup 20 extending through a suitable opening in cover 22, with a generally rigid accordianed rubber boot 23 surrounding rod 21 and retained therein between the peripheral lip 24 of cup 20 and flange 25 of elongated vertical hollow upper support 26. An angled horizontal support 27 is integral with support 26 having, at its terminal end, a vertical support portion 28 extending parallel to support 26.

As seen in FIG. 5, a plurality of spaced inwardly extending elongated flanges 29 extend along the interior wall 30 of support 26. A knurled knob 31 is provided having a screw portion 32 threaded into a threaded aperture 33 in side wall 34 of support 26. A stop 35 is provided between knob 31 and screw 32 of a greater diameter than screw 32 but lesser in diameter than knurled knob 31. As seen in FIG. 4 and 5, screw 32 abuts against rod 21 when tightened to support the rod 21 within support 26. As will be discussed, boot 23 provides some rocking motion to the apparatus 10.

Figures 2, 3:
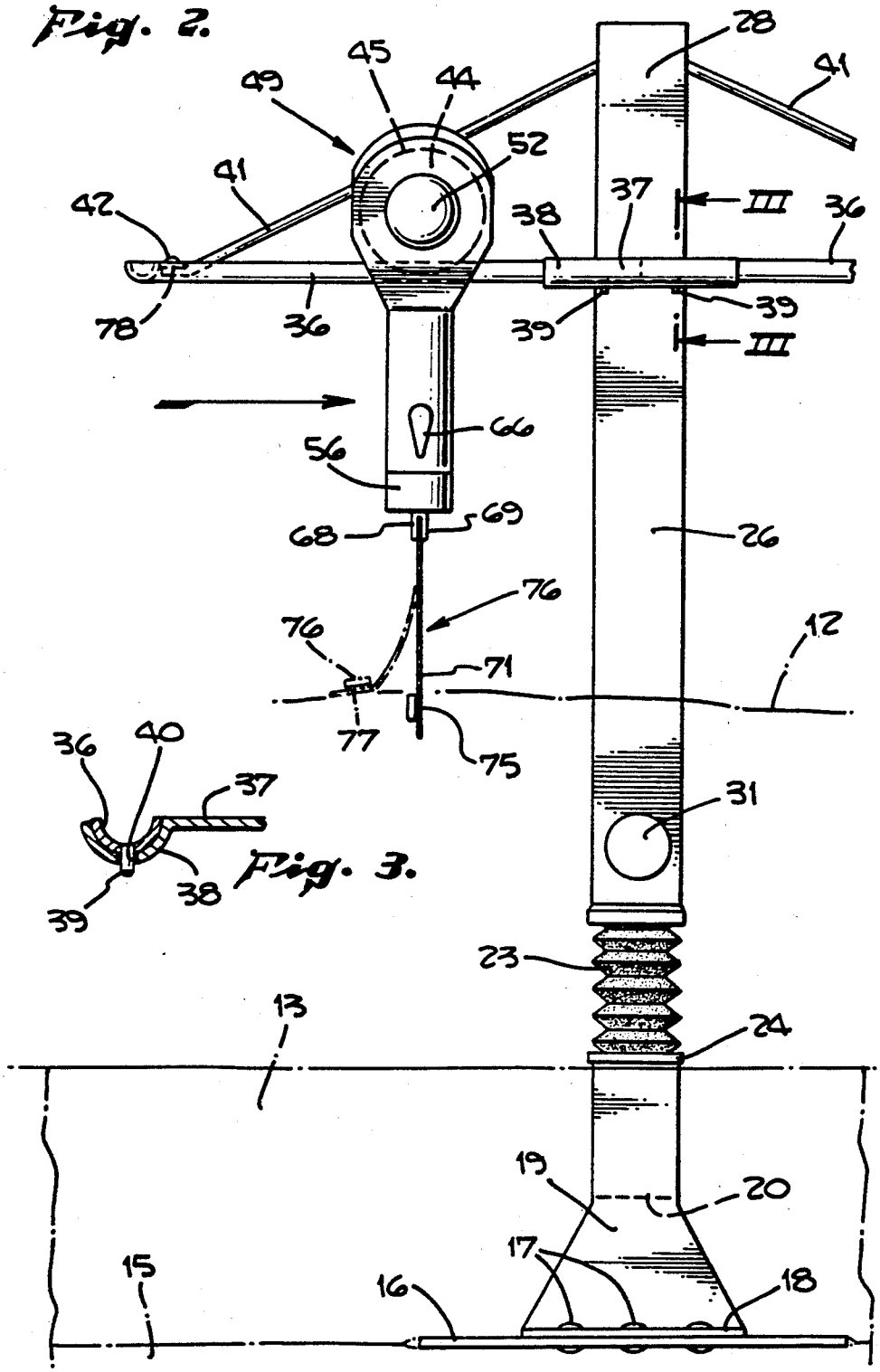
FIG. 2 is a vertical side view of a portion of the apparatus of FIG. 1.
FIG. 3 is a view taken along lines III—III of FIG. 2.

As seen in FIG. 1, an endless oval track 36 is supported on support portion 28. A flange plate 37 (see also FIG. 3) is fixed or otherwise secured to the terminal end of support portion 28 and, as particularly seen in FIG. 3, has curved end flanges 38. Track 36 may be provided in two sections, each section being U-shaped and terminating in pegs 39 receivable in holes or apertures 40 in flanges 38 (only one side of plate 37 being shown in FIG. 3—see FIG. 4). As seen in FIG. 3, track 36 is curved or arcuate conforming to the inner curvature of flanges 38.

Further support for track 36 is provided by a cable 41 (FIG. 2) having one end secured to an ear 78 (FIG. 1) on track 36 via rivet 42, passing through a suitable aperture 43 (FIG. 4) in support 27, the other end being secured to the opposite end of track 36 in any suitable manner, such as the rivet arrangement shown in FIG. 2.

Figure 7:
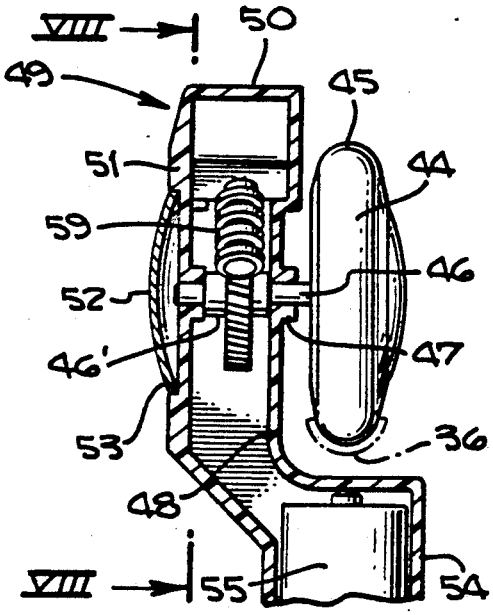
FIG. 7 is a vertical, partly sectional view of a portion of the endless track and roller of the apparatus of FIG. 1.

A roller 44 (FIGS. 1, 7 and 4) is provided having an outer peripheral surface 45 conforming to track 36 as clearly seen in FIG. 7. A centrally mounted shaft 46 is fixed to roller 44 and extends through an apertured boss 47 in side wall 48 of a motor housing 49. Motor housing 49 has a top wall 50 interconnecting side walls 48 and 51. A decorative cap 52 may be snap-fit into shoulder 53 on side wall 51 having indicia or the like or being otherwise illustrated.

Side walls 48, 51 merge at the bottom into a tubular battery housing 54, having one or more batteries 55 (FIG. 4) mounted therein. A removable cap 56 (FIG. 1) may close off the bottom of housing 54 for changing batteries.

Figure 8:
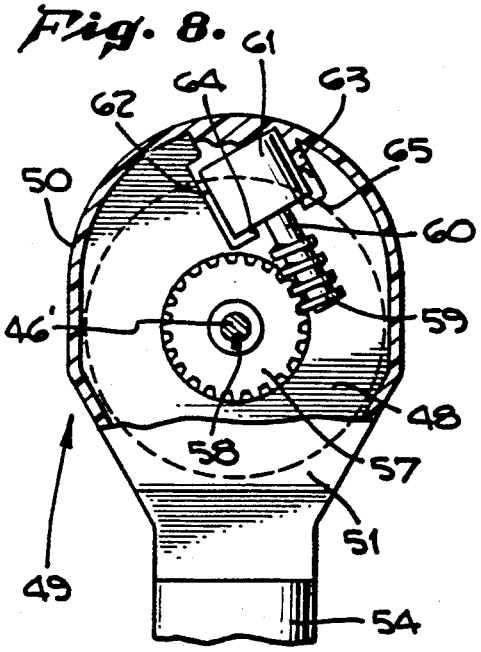
FIG. 8 is a view taken along lines VIII—VIII of FIG. 7.

As seen in FIG. 8, a round toothed gear 57 is keyed for rotation with shaft portion 46' via key 58. Shaft 46' (FIG. 7) is integral with shaft 46 and greater in diameter so that it is retained between the inner walls of side walls 48, 51. Gear 57 meshes with a worm gear 59 mounted on a motor shaft 60 extending from motor 61 and rotatable by motor 61. Motor 61 is snapped into mating flanges 62, 63 having lip portions 64, 65, respectively, for retaining motor 61 in fixed position within housing 49. It can be appreciated that, when motor 61 is activated, worm gear 59 rotates to rotate gear 57. This in turn rotates shaft 46 (via shaft portion 46') thus driving roller 44 about track 36. A suitable on/off switch 66 (FIG. 2) may be provided on housing 54 and it is to be understood that switch 66, batteries 55 and motor 61 are all electrically interconnected as is well known in the art.

As seen in FIG. 1, a massaging device 67 is provided on apparatus 10. As seen in FIGS., 1, 2 and 4, a pair of spaced elongated flange plates 68, 69 are provided fixed or otherwise secured to cap 56. A generally rectangular piece of resilient material, such as leather patch 70, is trapped between plates 68, 69 and retained therein. Patch 70 is cut into strips, such as flexible elements in the form of strips 71 to 74, (FIG. 4, at bottom) and, if desired, patches 75 (FIG. 2) of conventional hook and loop material, such as Velcro, a hook and loop fastener material manufactured by Velcro USA Inc. of Manchester, OH, may be provided on each strip 71 to 74 adjacent the bottom glued or otherwise adhered thereto. A weight 76, such as lead, may be provided with a mating Velcro patch 77 glued or otherwise adhered thereto adapted to engage patch 75 and thus removably and detachably secured weights 76 to strips 71 to 74. In this manner, the weights can be changed (to provide greater or lesser weight), or eliminated for a lighter massaging touch.

In operation, the user lies down on bed 11 as seen in FIG. 1. Switch 66 is turned on and roller 44 begins its endless travel along track 36. As it traverses track 36, strips 71 to 74 brush gently along the body of the user, as seen in FIG. 1, with their weighted ends (via weights 76) acting as massaging fingers along the user's body. The strips 71 to 74 move along the body, then, back around to a different area of the body. The user can of course change his or her position and massage other areas of the body. The height of support 26 can be adjusted via knob 31. The flange plates 16, 18, 19 can be varied to accommodate various types of beds, such as water beds. The apparatus 10 can be free standing, that is, rest on plate 16 (which would be the base) so it could be portable and usable anywhere (e.g., by the user merely lying on a towel). The accordianed boot 23 imparts a rocking movement or sensation to the moving strips 71 to 74. If desired, speed of the motor 61 may be controlled in any suitable manner.

Thus, there is disclosed a unique and inexpensive apparatus for massaging one's body in the privacy of one's home.

I claim:

1. Apparatus for massaging the body of a user comprising:

a support;

an endless track mounted on said support;

a roller movable along said endless track;

motive means coupled to the roller for moving said roller along said track; and massaging means associated with said roller for moving a plurality of flexible elements along the body of a user as the roller moves along said track, said support including a flange plate adapted to be inserted between a mattress and a box spring of a bed, an upright generally vertical first support member coupled to said flange plate, a generally horizontal second support member integral with and extending from said first support member and an integral generally vertical third support member extending from said second support member and generally parallel to said first support member, said endless track being mounted on said third support member.

2. In the apparatus of claim 1 wherein said endless track is vertically adjustable with respect to said support.

3. In the apparatus of claim 1 wherein said endless track is resiliently support with respect to said supported whereby said massaging means can rock with respect to said support.

4. In the apparatus of claim 1 wherein said motive means includes a motor housing having a motor, a worm gear rotatable by said motor, a round gear meshing with said worm gear, and a shaft fixed for rotation to both said round gear and said roller.

5. In the apparatus of claim 4 wherein said motive means further includes a battery compartment adapted to contain at least one battery therein fixed to said motor housing, said massaging means being mounted to said battery compartment and extending downwardly therefrom.

6. In the apparatus of claim 5 wherein said massaging means includes a flexible patch secured to said battery compartment, said flexible patch terminating at the bottom in said plurality of flexible elements.

7. In the apparatus of claim 6 wherein said patch is leather material and said elements are strips of said leather material cut therefrom.

8. In the apparatus of claim 7 including a plurality of weights detachably secured to one or more of said elements.

9. In the apparatus of claim 8 wherein said weights are detachably mounted to said elements by patches of mating hook and loop fastener material.

10. In the apparatus of claim 1 wherein said massaging means includes a flexible patch secured to said motive means, said flexible patch terminating at the bottom in said plurality of flexible elements.

11. In the apparatus of claim 10 wherein said patch is of leather material and said elements are strips of said leather material cut out therefrom.

12. In the apparatus of claim 11 including a plurality of weights detachably secured to one or more of said elements.

13. In the apparatus of claim 12 wherein said weights are detachably mounted to said elements by patches of mating, hook and loop fastener material.

14. Apparatus for massaging the body of a user comprising:

a support;

an endless track mounted on said support;

a roller movable along said endless track;

motive means coupled to the roller for moving said roller along said track; and massaging means associated with said roller for moving a plurality of flexible elements along the body of a user as the roller moves along said track, said motive means including a motor housing having a motor, a worm gear rotatable by said motor, a round gear meshing with said worm gear, and a shaft fixed for rotation to both said round gear and said roller.

15. In the apparatus of claim 14 wherein said motive means further includes a battery compartment adapted to contain at least one battery therein fixed to said motor housing, said massaging means being mounted to said battery compartment and extending downwardly therefrom.

16. In the apparatus of claim 15 wherein said massaging means includes a flexible patch secured to said battery compartment, said flexible patch terminating at the bottom in said plurality of flexible elements.

17. In the apparatus of claim 16 wherein said patch is leather material and said elements are strips of said leather material cut therefrom.

18. In the apparatus of claim 17 including a plurality of weights detachably secured to one or more of said elements.

19. In the apparatus of claim 18 wherein said weights are detachably mounted to said elements by patches of mating hook and loop fastener material.

* * * * *